US012173633B2

(12) United States Patent
Johnson et al.

(10) Patent No.: US 12,173,633 B2
(45) Date of Patent: Dec. 24, 2024

(54) EXHAUST ASSEMBLY

(71) Applicant: TENNECO AUTOMOTIVE OPERATING COMPANY INC., Lake Forest, IL (US)

(72) Inventors: Jason C. Johnson, Brighton, MI (US); Bradley Smith, Ann Arbor, MI (US); Brett Herwat, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 252 days.

(21) Appl. No.: 17/965,031

(22) Filed: Oct. 13, 2022

(65) Prior Publication Data

US 2023/0122518 A1 Apr. 20, 2023

Related U.S. Application Data

(60) Provisional application No. 63/255,570, filed on Oct. 14, 2021.

(51) Int. Cl.
*F01N 13/08* (2010.01)
*F01N 13/18* (2010.01)

(52) U.S. Cl.
CPC ..... *F01N 13/082* (2013.01); *F01N 13/1805* (2013.01)

(58) Field of Classification Search
CPC ..... F01N 13/1888; F01N 2260/20; F01N 2260/14; F01N 2260/022; F01N 13/1805; F01N 13/082; F01N 13/1872; F01N 1/08
See application file for complete search history.

(56) References Cited

U.S. PATENT DOCUMENTS

| | | | | |
|---|---|---|---|---|
| 7,007,720 | B1 * | 3/2006 | Chase | F16L 59/12 181/227 |
| 8,550,122 | B2 | 10/2013 | Derry et al. | |
| 8,733,086 | B2 | 5/2014 | Han et al. | |
| 10,072,555 | B2 * | 9/2018 | Kiryu | F01N 13/082 |
| 10,227,050 | B2 | 3/2019 | Hodges | |
| 10,344,658 | B2 * | 7/2019 | Minowa | F01N 13/082 |
| 2013/0152559 | A1 | 6/2013 | Pawl | |
| 2018/0149071 | A1 * | 5/2018 | Mueller | F01N 13/082 |

FOREIGN PATENT DOCUMENTS

| | | | |
|---|---|---|---|
| DE | 10355472 | B4 | 6/2009 |
| EP | 1916393 | A1 | 4/2008 |
| JP | 2020056345 | A | 4/2020 |
| KR | 102119670 | B1 | 6/2020 |

* cited by examiner

*Primary Examiner* — Anthony Ayala Delgado
(74) *Attorney, Agent, or Firm* — McGarry Bair PC

(57) ABSTRACT

An exhaust assembly includes a first tailpipe having an exit end and a curved portion along at least a portion of a length of the first tailpipe. The exhaust assembly further includes a baffle surrounding the first tailpipe at the exit end and defining a plurality of perforations therethrough. The exhaust assembly further includes a pair of shields. Each shield is attached to and at least partially surrounds each of the baffle and the first tailpipe. Each shield extends from a first end proximal to the exit end of the first tailpipe to a second end distal to the exit end of the first tailpipe. Each shield engages the baffle at the first end and engages the first tailpipe at least at or proximal to the second end. The pair of shields is adapted to allow fluid flow to or from the plurality of perforations of the baffle.

20 Claims, 10 Drawing Sheets

EXHAUST ASSEMBLY

CROSS REFERENCE TO RELATED APPLICATIONS

This application claims priority under 35 USC § 119(e) to U.S. Provisional Patent Application No. 63/255,570, filed Oct. 14, 2021, entitled "EXHAUST ASSEMBLY," which is hereby incorporated herein reference in its entirety.

TECHNICAL FIELD

The present disclosure relates to an exhaust assembly, and in particular to an exhaust assembly for a vehicle.

BACKGROUND

Exhaust devices and/or mufflers are commonly used in vehicle exhaust systems to reduce noise and remove pollutants from the exhaust gas prior to being discharged into the atmosphere through at least one tailpipe. Exhaust noise is generally reduced by decreasing temperature and/or pressure of the exhaust gas. In some vehicle exhaust systems, the muffler is provided with multiple tailpipes to discharge the exhaust gas into the atmosphere.

In conventional exhaust devices having the muffler with two tailpipes, a diameter of one of the tailpipes can have to be reduced to achieve an improved acoustic performance of the muffler. However, by doing this, the two tailpipes have different diameters (size) which cannot be aesthetically appealing. Thus, different size tailpipes in the muffler can adversely impact an aesthetic appearance of a vehicle.

Moreover, temperature of the tailpipes, especially for diesel particulate filter applications, can reach to about 650° C. Such temperatures of the tailpipes can potentially ignite flammable materials, such as dry grass along a roadside. Further, due to high temperatures, thermal distortion of the tailpipes can also occur. Therefore, for an exhaust assembly with two or more tailpipes, there exists a need of a component for providing cooling of the tailpipes, improved acoustic performance, and satisfactory aesthetic appearance of the vehicle.

SUMMARY

According to a first aspect, an exhaust assembly is provided. The exhaust assembly includes a first tailpipe including an exit end defining an outlet. The first tailpipe further includes a curved portion along at least a portion of a length of the first tailpipe. The first tailpipe is adapted to discharge an exhaust gas through the outlet. The exhaust assembly further includes a baffle surrounding the first tailpipe at the exit end. The baffle defines a plurality of perforations therethrough. The exhaust assembly further includes a pair of shields formed as separate parts. Each shield is attached to and at least partially surrounds each of the baffle and the first tailpipe. Each shield extends from a first end proximal to the exit end of the first tailpipe to a second end distal to the exit end of the first tailpipe. Each shield engages the baffle at the first end and engages the first tailpipe at least at or proximal to the second end. Each shield is at least partially curved along its length. Such a curve is complementary in shape to a curve of the curved portion of the first tailpipe, such that each shield at least partially surrounds the curved portion of the first tailpipe. The pair of shields is adapted to allow fluid flow to or from the plurality of perforations of the baffle.

According to a second aspect, an exhaust assembly is provided. The exhaust assembly includes a muffler housing. The exhaust assembly further includes a first tailpipe connected to the muffler housing and having a first outer diameter. The first tailpipe includes an exit end defining an outlet. The first tailpipe further includes a curved portion along at least a portion of a length of the first tailpipe. The first tailpipe is adapted to discharge an exhaust gas through the outlet. The exhaust assembly further includes a baffle surrounding the first tailpipe at the exit end. The baffle defines a plurality of perforations therethrough. The baffle has a baffle outer diameter. The exhaust assembly further includes a pair of shields formed as separate parts. Each shield is attached to and at least partially surrounds each of the baffle and the first tailpipe. Each shield extends from a first end proximal to the exit end of the first tailpipe to a second end distal to the exit end of the first tailpipe. Each shield engages the baffle at the first end and engages the first tailpipe at least at or proximal to the second end. Each shield is at least partially curved along its length. Such a curve is complementary in shape to a curve of the curved portion of the first tailpipe, such that each shield at least partially surrounds the curved portion of the first tailpipe. The pair of shields is adapted to allow fluid flow to or from the plurality of perforations of the baffle. The exhaust assembly further includes a second tailpipe spaced apart from the first tailpipe and connected to the muffler housing. The second tailpipe has a second outer diameter greater than the first outer diameter of the first tailpipe. The second outer diameter is substantially equal to the baffle outer diameter of the baffle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

Figure 1:
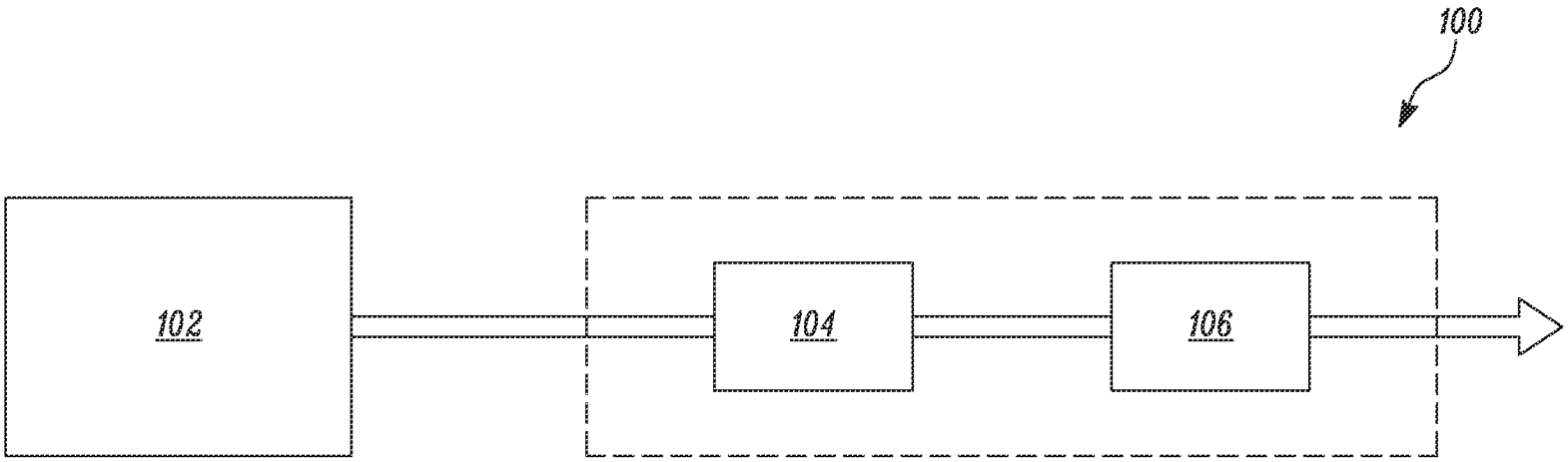
FIG. 1 is a schematic representation of a vehicle exhaust system, according to an embodiment of the present disclosure.

The following description is merely exemplary in nature and is in no way intended to limit the disclosure, its application, or uses. Referring now to the drawings in which like reference numerals designate like or corresponding parts throughout the several views, there as shown in FIG. 1. Referring to FIG. 1, a schematic representation of a vehicle exhaust system 100 is illustrated. The vehicle exhaust system 100 will be hereinafter interchangeably referred to as the "system 100". The system 100 can be fluidly coupled to an engine 102. The engine 102 can be any internal combustion engine powered by a fuel, such as diesel, gasoline, natural gas, and/or a combination thereof. Accordingly, the system 100 receives exhaust gas generated by the engine 102.

The system 100 can include a number of downstream exhaust components 104 fluidly coupled to the engine 102. The exhaust components 104 can include a number of systems/components (not shown), such as a Diesel Oxidation Catalyst (DOC), a Diesel Exhaust Fluid (DEF) unit, a Selective Catalytic Reduction (SCR) unit, a particulate filter, an exhaust pipe, an active valve, a passive valve, an Exhaust Gas Heat Recovery System (EGHR), and the like. The exhaust components 104 can be mounted in various different configurations and combinations based on application requirements and/or available packaging space. The exhaust components 104 are adapted to receive the exhaust gas from the engine 102 and direct the exhaust gas to the external atmosphere via an exhaust assembly 106. The exhaust components 104 and the exhaust assembly 106 are adapted to reduce emissions and control noise, and can also be used for thermal management.

In another embodiment, the engine 102 can be part of a hybrid system, i.e., the engine 102 can be operatively coupled with an electric motor and a battery. Further, the exhaust components 104 of the system 100 can be operational only when the engine 102 is burning fuel and not operational when the engine 102 is not running.

In some embodiments, the exhaust assembly 106 includes an acoustic damping exhaust device, such as a muffler. In some other embodiments, the exhaust assembly 106 can alternatively or additionally perform exhaust treatment functions. In some cases, the exhaust assembly 106 is adapted to dampen resonance frequencies generated during operation of the engine 102. In some embodiments, the exhaust assembly 106 can also include catalyst substrates for exhaust gas purification in addition to exhaust gas noise attenuation. In some other embodiments, the system 100 can include a hybrid design that combines the exhaust components 104 and the exhaust assembly 106 to include both emissions and acoustics tuning elements.

Figure 2:
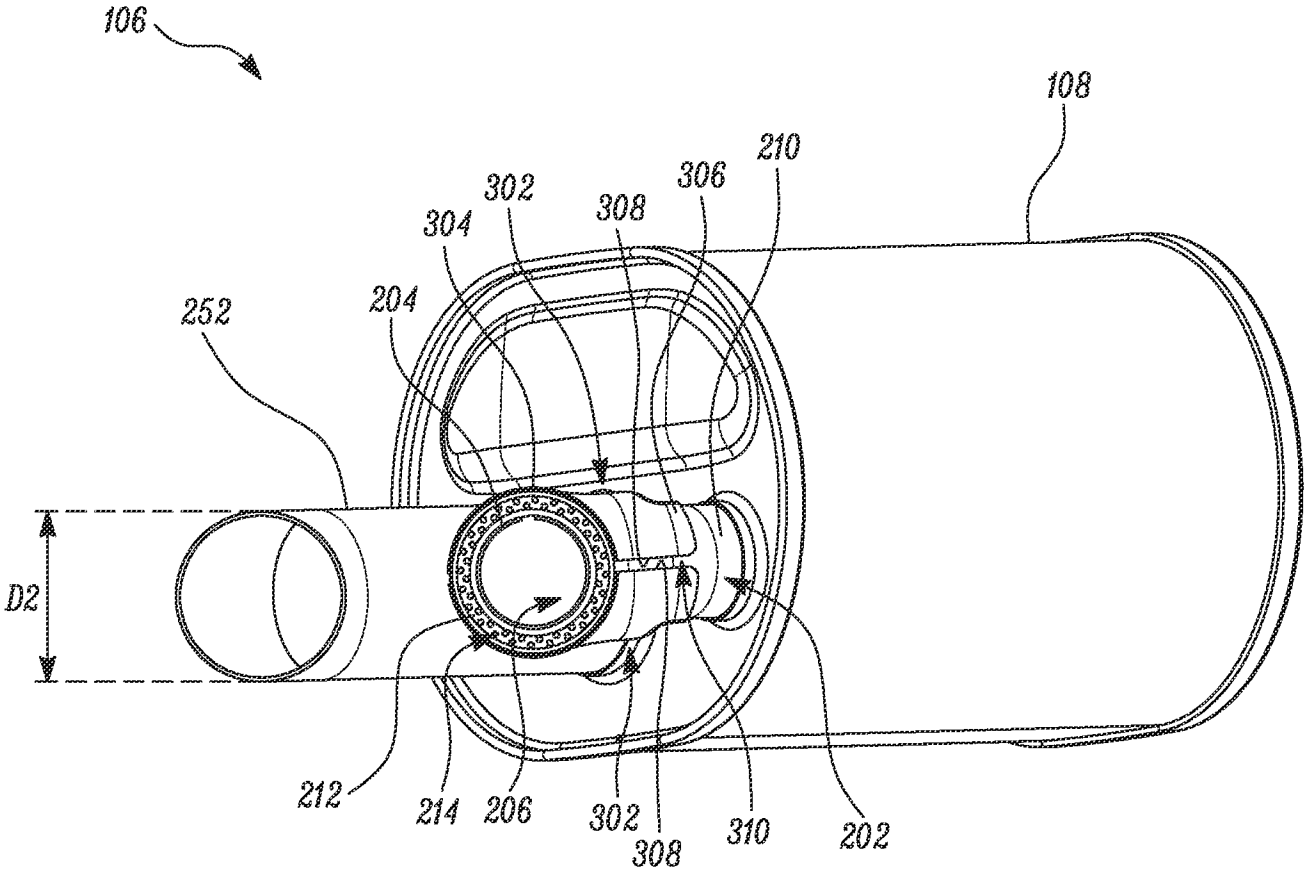
FIG. 2 is a side perspective view of an exhaust assembly of the vehicle exhaust system of FIG. 1, according to an embodiment of the present disclosure.
Figure 3:
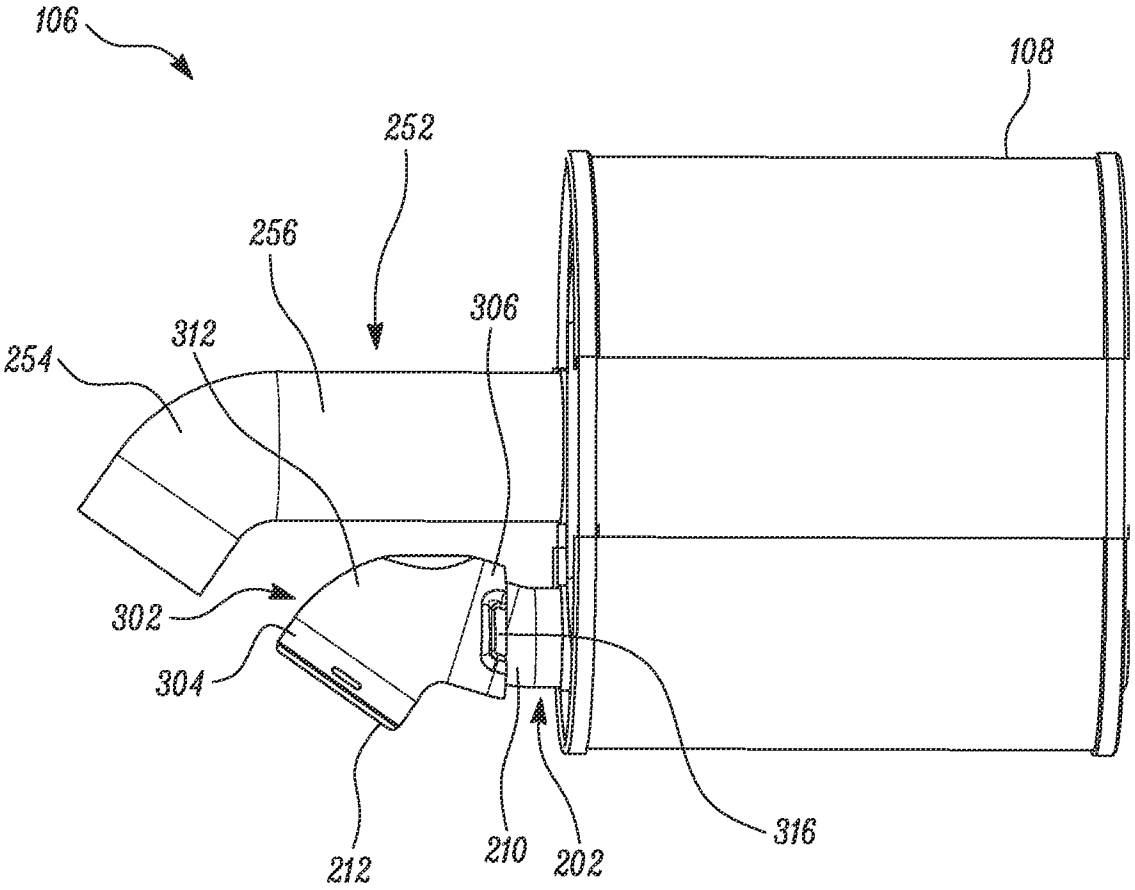
FIG. 3 is a top perspective view of the exhaust assembly of FIG. 2, according to an embodiment of the present disclosure.

FIG. 2 is a side perspective view of the exhaust assembly 106, according to an embodiment of the present disclosure. FIG. 3 is a top perspective view of the exhaust assembly 106. Referring to FIGS. 2 and 3, the exhaust assembly 106 includes a muffler housing 108 and a first tailpipe 202 connected to the muffler housing 108. The first tailpipe 202 includes an exit end 204 defining an outlet 206. The first tailpipe 202 is adapted to discharge the exhaust gas through the outlet 206. In other words, the first tailpipe 202 is designed to receive the exhaust gas from the muffler housing 108 and release the exhaust gas away from a vehicle (not shown) through the outlet 206.

Figure 4:
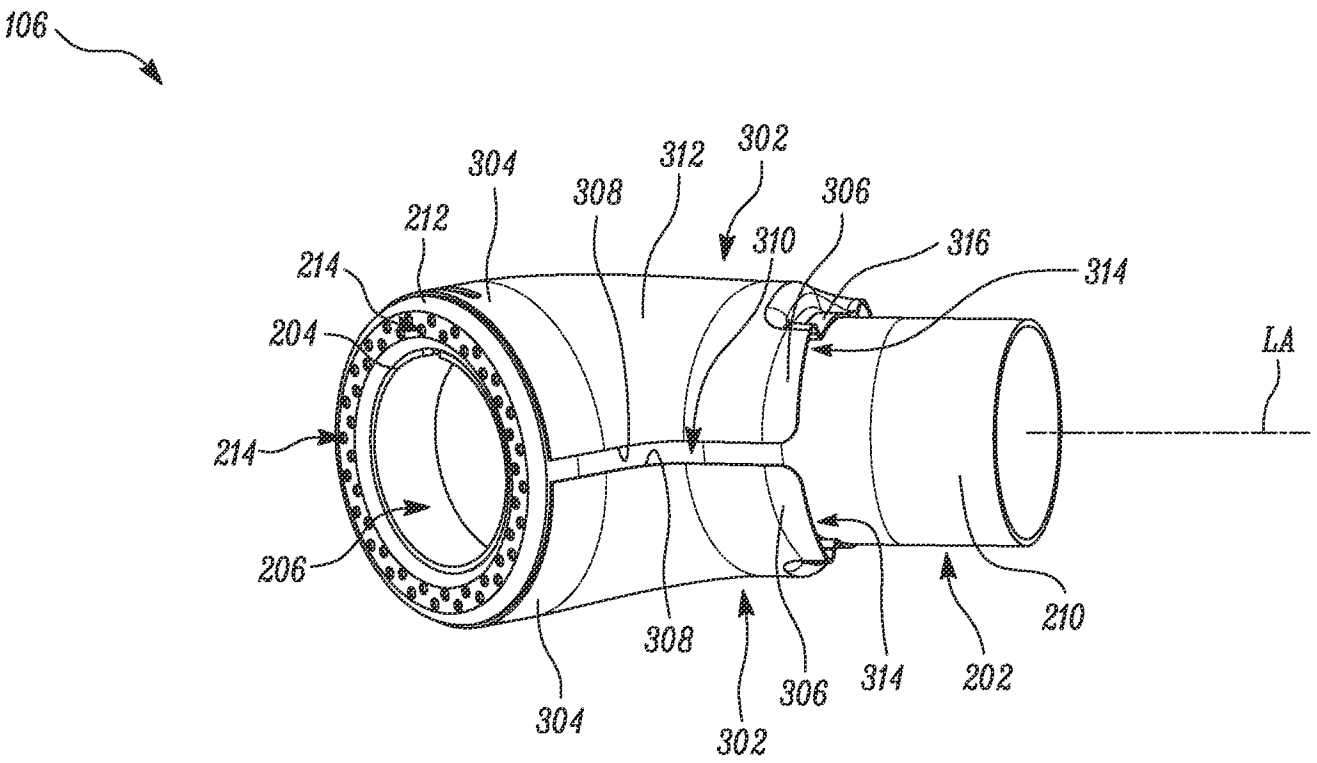
FIG. 4 is a detailed side perspective view of the exhaust assembly of FIG. 2 with some components not shown, according to an embodiment of the present disclosure.
Figure 5:
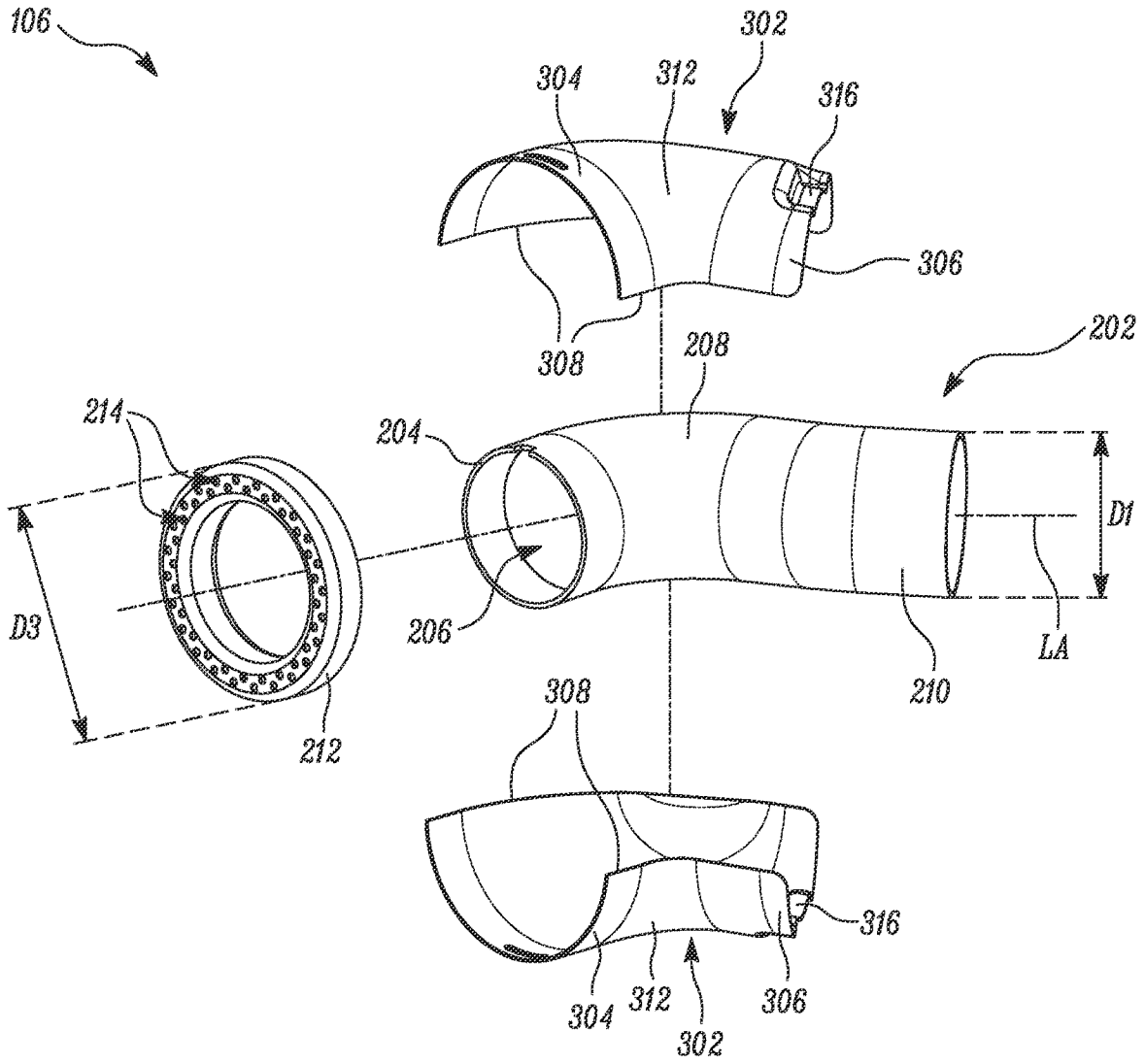
FIG. 5 is an exploded view of the exhaust assembly of FIG. 4, according to an embodiment of the present disclosure.

FIG. 4 is a detailed side perspective view of the exhaust assembly 106 of FIGS. 2 and 3 without the muffler housing 108 and a second tailpipe 252. FIG. 5 is an exploded view of the exhaust assembly 106. The muffler housing 108 and the second tailpipe 252 are not shown in FIGS. 4 and 5 for illustrative purposes. Referring to FIGS. 4 and 5, the first tailpipe 202 further includes a curved portion 208 (also shown in FIG. 7) along at least a portion of a length of the first tailpipe 202. The first tailpipe 202 further defines a longitudinal axis LA and includes a straight portion 210 extending parallel to the longitudinal axis LA. The straight portion 210 of the first tailpipe 202 can be connected to the muffler housing 108 (shown in FIGS. 2 and 3).

The curved portion 208 of the first tailpipe 202 extends from the exit end 204 to the straight portion 210 of the first tailpipe 202. Thus, the curved portion 208 is proximal to the exit end 204 and the straight portion 210 is distal to the exit end 204. The first tailpipe 202 has a first outer diameter D1. In some embodiments, the first outer diameter D1 is substantially constant throughout the length of the first tailpipe 202.

Referring again to FIGS. 2 and 3, the exhaust assembly 106 can further include the second tailpipe 252 spaced apart from the first tailpipe 202. The second tailpipe 252 can also be connected to the muffler housing 108. Therefore, the muffler housing 108 is connected to each of the first tailpipe 202 and the second tailpipe 252. The first tailpipe 202 and the second tailpipe 252 are attached to the muffler housing 108 at respective different spaced locations.

Referring to FIGS. 1, 2, and 5, in some embodiments, the second tailpipe 252 can have a second outer diameter D2 greater than the first outer diameter D1 of the first tailpipe 202. In some embodiments, the first outer diameter D1 can be at most 90% of the second outer diameter D2. In some other embodiments, the first outer diameter D1 can be at most 80%, at most 70%, or at most 60% of the second outer diameter D2. The second tailpipe 252 can include a curved portion 254 along at least a portion of a length of the second tailpipe 252. The second tailpipe 252 further includes a straight portion 256 connected to the muffler housing 108. The second tailpipe 252 is designed to receive the exhaust gas from the muffler housing 108 and release the exhaust gas away from a vehicle (not shown) to ambient environment.

With reference to FIGS. 2-5, the exhaust assembly 106 further includes a baffle 212 surrounding the first tailpipe 202 at the exit end 204. The baffle 212 defines a plurality of perforations 214 therethrough. In some embodiments, the baffle 212 can define a plurality of slots or vent openings. The baffle 212 has a baffle outer diameter D3. In some embodiments, the second outer diameter D2 of the second tailpipe 252 is substantially equal to the baffle outer diameter D3 of the baffle 212. In some embodiments, the baffle outer diameter D3 of the baffle 212 is greater than the first outer diameter D1 of the first tailpipe 202.

The exhaust assembly 106 further includes a pair of shields 302 formed as separate parts. This means that both of the shields 302 are assembled in the exhaust assembly 106 as two separate components. In some embodiments, the shields 302 can have a similar design. Each shield 302 extends from a first end 304 proximal to the exit end 204 of the first tailpipe 202 to a second end 306 distal to the exit end 204 of the first tailpipe 202.

In some embodiments, each shield 302 can be made of steel, or aluminized steel, aluminum sheets. In some embodiments, each shield 302 can be composed of a thermoset, such as polyvinylester produced from a compression molding, glass matte transfer molding, or bulk molding process. Each shield 302 can be manufactured by injection molding, sheet molding, vacuum forming, or blow molding. In some embodiments, each shield 302 is a stamped part.

Each shield 302 engages the baffle 212 at the first end 304. Further, each shield 302 is attached to and at least partially surrounds the baffle 212. In some embodiments, each shield 302 is attached to the baffle 212 at the first end 304. In some embodiments, each shield 302 can be welded to the baffle 212 at the first end 304.

Further, each shield 302 engages the first tailpipe 202 at least at or proximal to the second end 306. Each shield 302 defines a recessed portion 316 at the second end 306. Each shield 302 is attached to and at least partially surrounds the first tailpipe 202. Therefore, each shield 302 is attached to and at least partially surrounds each of the baffle 212 and the first tailpipe 202. In some embodiments, each shield 302 is attached to the first tailpipe 202 at least at or proximal to the second end 306. Specifically, the recessed portion 316 of each shield 302 is attached to the first tailpipe 202. In other words, the second end 306 of each shield 302 is attached to the curved portion 208 of the first tailpipe 202. In some embodiments, the second end 306 of each shield 302 engages the curved portion 208 of the first tailpipe 202. In some embodiments, each shield 302 is welded to the first tailpipe 202. In some other embodiments, each shield 302 is attached to the first tailpipe 202 by a clamp. In some embodiments, the recessed portion 316 of each shield 302 engages the curved portion 208 of the first tailpipe 202. Further, the recessed portion 316 can be attached to the curved portion 208 via welding and/or clamping.

In some embodiments, each shield 302 is spaced apart from an outer surface of the first tailpipe 202 except at the corresponding recessed portion 316. In other words, each shield 302 and the outer surface of the first tailpipe 202 can define a gap or a clearance therebetween that allows flow of fluid between each shield 302 and the outer surface of the first tailpipe 202.

In some embodiments, each shield 302 includes a pair of opposing longitudinal edges 308 extending from the first end 304 to the second end 306. Each longitudinal edge 308 of one shield 302 is spaced apart from an adjoining longitudinal edge 308 of the other shield 302. The longitudinal edges 308 of one shield 302 are spaced apart from the adjoining longitudinal edges 308 of the other shield 302, such that the pair of shields 302 define a pair of shield gaps 310 (shown in FIGS. 2 and 4) therebetween extending from respective first ends 304 to the respective second ends 306. In other words, each shield gap 310 is defined between each longitudinal edge 308 of one shield 302 and the adjoining longitudinal edge 308 of the other shield 302. Further, each shield gap 310 is in fluid communication with the plurality of perforations 214 of the baffle 212. In some embodiments, each longitudinal edge 308 of each shield 302 at least partially surrounds and engages the baffle 212.

Figure 6A:
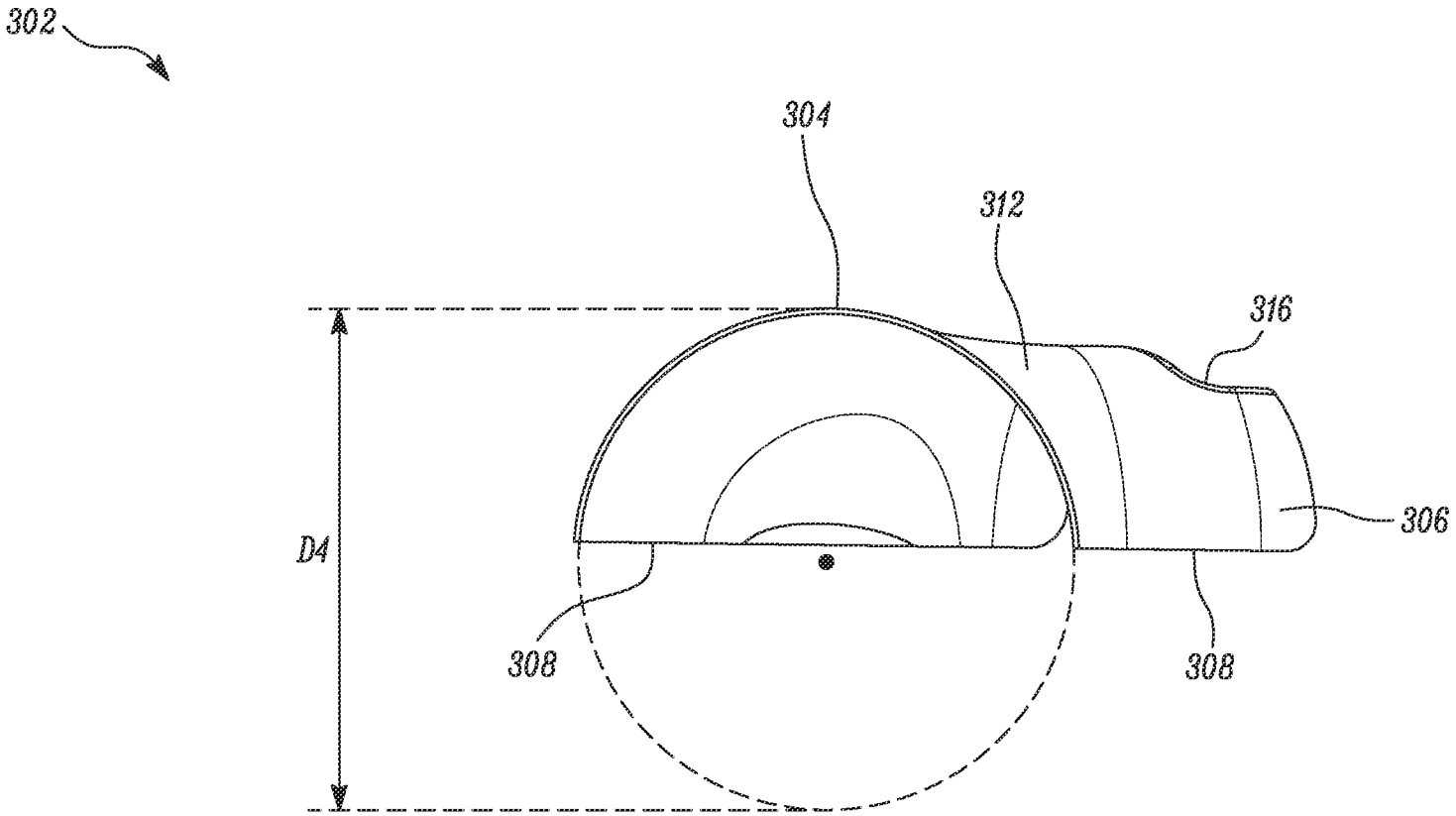
FIG. 6A is a front perspective view of a shield of the exhaust assembly of the vehicle exhaust system of FIG. 1, according to an embodiment of the present disclosure.
Figure 6B:
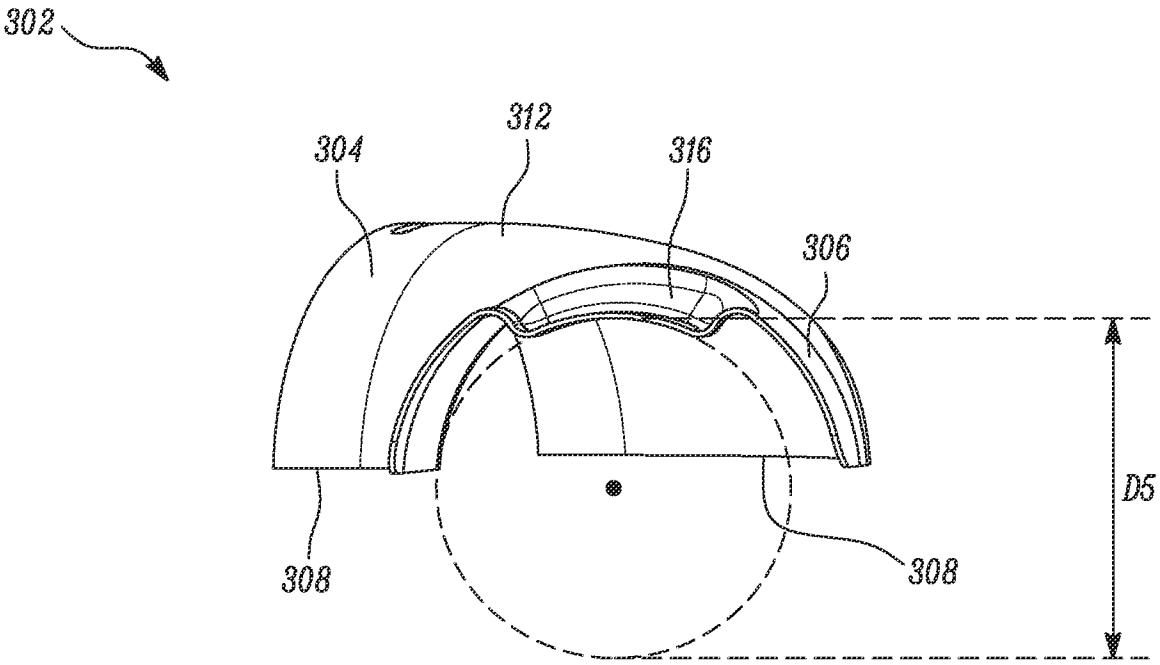
FIG. 6B is a rear perspective view of the shield of FIG. 6A, according to an embodiment of the present disclosure.

FIG. 6A is a front perspective of each shield 302, according to an embodiment of the present disclosure. FIG. 6B is a rear perspective of each shield 302. With reference to FIGS. 6A and 6B, in some embodiments, each shield 302 has a first inner diameter D4 at the first end 304 and a second minimum inner diameter D5 at the second end 306. The first inner diameter D4 is greater than the second minimum inner diameter D5. In some embodiments, the second minimum inner diameter D5 can be at least 50% of the first inner diameter D4. In some other embodiments, the second minimum inner diameter D5 can be at least 60% or at least 70% of the first inner diameter D4. In such cases, as the first inner diameter D4 at the first end 304 is greater than the second minimum inner diameter D5 at the second end 306, each shield 302 at least partially tapers from the first end 304 to the second end 306.

With reference to FIGS. 4, 5, and 6A, in some embodiments, the first inner diameter D4 is equal to or greater than the baffle outer diameter D3. With reference to FIGS. 4, 5, and 6B, in some embodiments, the second minimum inner diameter D5 is equal to or greater than the first outer diameter D1 of the first tailpipe 202. Further, the first inner diameter D4 is greater than the first outer diameter D1 of the first tailpipe 202.

As the baffle outer diameter D3 of the baffle 212 is substantially equal to the second outer diameter D2 of the second tailpipe 252, a visual affect can be produced for a person viewing from outside that the first tailpipe 202 and the second tailpipe 252 have substantially same diameters. In other words, the first tailpipe 202 and the second tailpipe 252 can look substantially equal in size when viewed from outside a vehicle having the exhaust assembly 106. However, for obtaining an improved acoustic performance of the exhaust assembly 106, the first outer diameter D1 of the first tailpipe 202 has to be smaller than the second outer diameter D2 of the second tailpipe 252. Attaching the pair of shields 302 to the first tailpipe 202 can not only improve the vehicle aesthetic performance (visual effect of same diameters of the first tailpipe 202 and the second tailpipe 252) but also enable the exhaust assembly 106 to achieve an effective acoustic performance (due to smaller diameter of the first tailpipe 202). Therefore, the pair of shields 302 attached to the first tailpipe 202 can improve the vehicle aesthetics and maintain a targeted acoustic performance. Hence, a commercial value of a vehicle including the exhaust assembly 106 can improve.

Moreover, as the first outer diameter D1 of the first tailpipe 202 is smaller than the second outer diameter D2 of the second tailpipe 252, a relatively less material is used for manufacturing the first tailpipe 202. Less consumption of material can further reduce an overall manufacturing cost of the first tailpipe 202 and the exhaust assembly 106. Further, the disclosed exhaust assembly 168 cannot add any unnecessary weight and cost in the overall manufacturing process.

Figure 7:
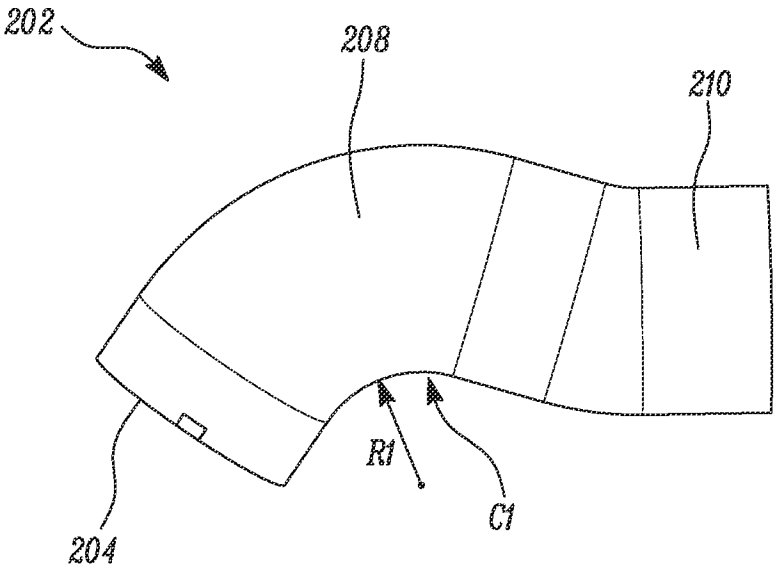
FIG. 7 is a top perspective view of a first tailpipe of the exhaust assembly of FIG. 2, according to an embodiment of the present disclosure.

FIG. 7 is a top view of the first tailpipe 202, according to an embodiment of the present disclosure. As shown in FIG. 7, the curved portion 208 of the first tailpipe 202 extends from the exit end 204 to the straight portion 210 of the first tailpipe 202. The curved portion 208 of the first tailpipe 202 follows a curve C1. The curve C1 of the curved portion 208 has a radius of curvature R1.

Figure 8:
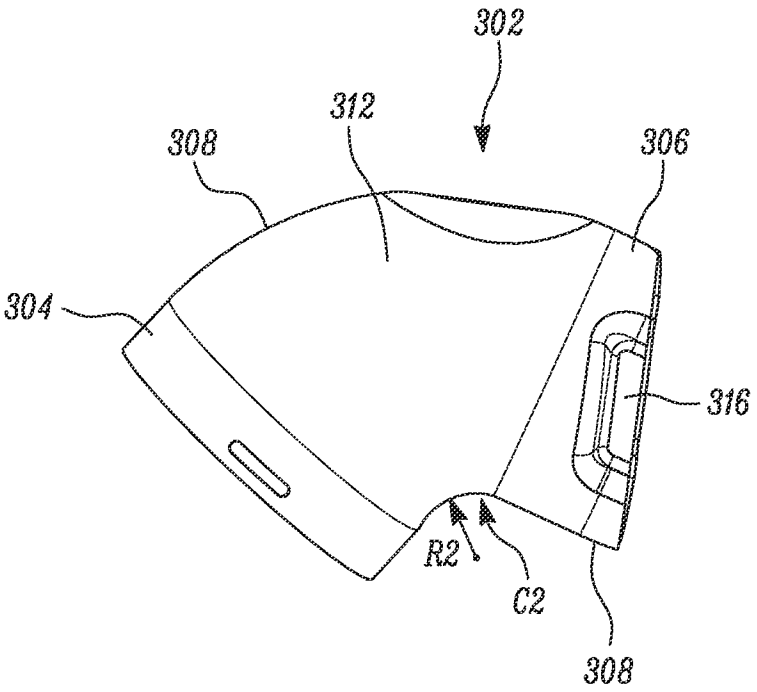
FIG. 8 is a top perspective view of the shield of FIG. 6A, according to an embodiment of the present disclosure.

FIG. 8 is a top view of each shield 302, according to an embodiment of the present disclosure. Each shield 302 is at least partially curved along its length. Specifically, each shield 302 includes a curved portion 312 extending from the first end 304 to the second end 306. The curved portion 312 of each shield 302 follows a curve C2. The curve C2 of the curved portion 312 has a radius of curvature R2.

The curve C2 of the curved portion 312 of each shield 302 is complementary in shape to the curve C1 of the curved portion 208 of the first tailpipe 202. As a result, each shield 302 at least partially surrounds the curved portion 208 of the first tailpipe 202. Specifically, the curved portion 312 of each shield 302 at least partially surrounds the curved portion 208 of the first tailpipe 202.

Figure 9:
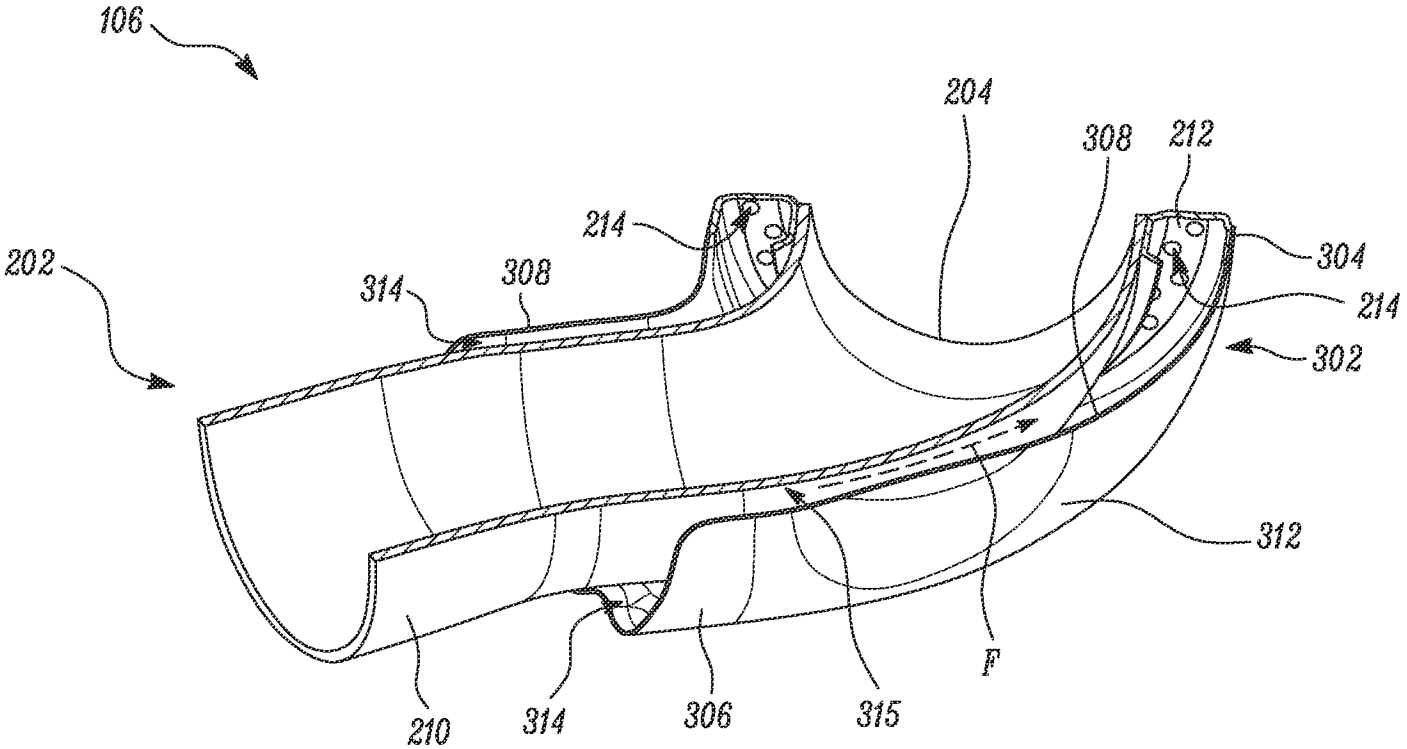
FIG. 9 is a cut away view of the exhaust assembly of FIG. 4, according to an embodiment of the present disclosure.

FIG. 9 is a cut away of the exhaust assembly 106, according to an embodiment of the present disclosure. However, the muffler housing 108 and the second tailpipe 252 are not shown in FIG. 9 for illustrative purposes. With reference to FIGS. 4 and 9, in some embodiments, each shield 302 further includes at least one opening 314 at the second end 306. In some embodiments, each shield 302 can include two or more openings 314 at the second end 306. The at least one opening 314 is in fluid communication with the plurality of perforations 214 of the baffle 212. In some embodiments, the at least one opening 314 of each shield 302 is defined between the corresponding shield 302 and the first tailpipe 202. Therefore, the pair of shields 302 is adapted to allow fluid flow to or from the plurality of perforations 214 of the baffle 212. In some embodiments, each shield 302 can include a plurality of perforations (not shown) in fluid communication with the plurality of perforations 214 of the baffle 212.

As the at least one opening 314 is in fluid communication with the plurality of perforations 214 of the baffle 212, an axial passage 315 (shown in FIG. 9) is generated for ambient air to travel from surroundings to the baffle 212. Particularly, ambient air from outside travels through the at least one opening 314 and the axial passage 315 to cool the curved portion 208 of the first tailpipe 202. Flow of ambient air (indicated by arrow F) through the axial passage 315 can keep the first tailpipe 202 relatively cool as compared to direct cooling of the first tailpipe 202 by ambient air without the perforations 214 of the baffle 212. Further, ambient air which has been used for heat exchange with the first tailpipe 202 can exit from the exhaust assembly 106 through the plurality of perforations 214 of the baffle 212. The inclusion of the baffle 212 with the plurality of perforations 214 can allow continuous and effective flow of ambient air through the at least one opening 314 and the axial passage 315, and therefore provides effective cooling of the first tailpipe 202. Thus, the inclusion of the baffle 212 with the plurality of perforations 214 can prevent a temperature of the first tailpipe 202 to increase which could have otherwise happened by only providing the pair of shields 302 (without the baffle 212) at least partially surrounding the first tailpipe 202. An effective cooling of the first tailpipe 202 can reduce deterioration of the material of the first tailpipe 202. Moreover, flow of ambient air through the axial passage 315 can enhance cooling of each shield 302. An improved cooling of each shield 302 can protect other components in close proximity, such as cables, wires, rear fascia, from excessive heating. Therefore, the exhaust assembly 106 including the first tailpipe 202 can be operational for a relatively longer time period.

Figure 10:
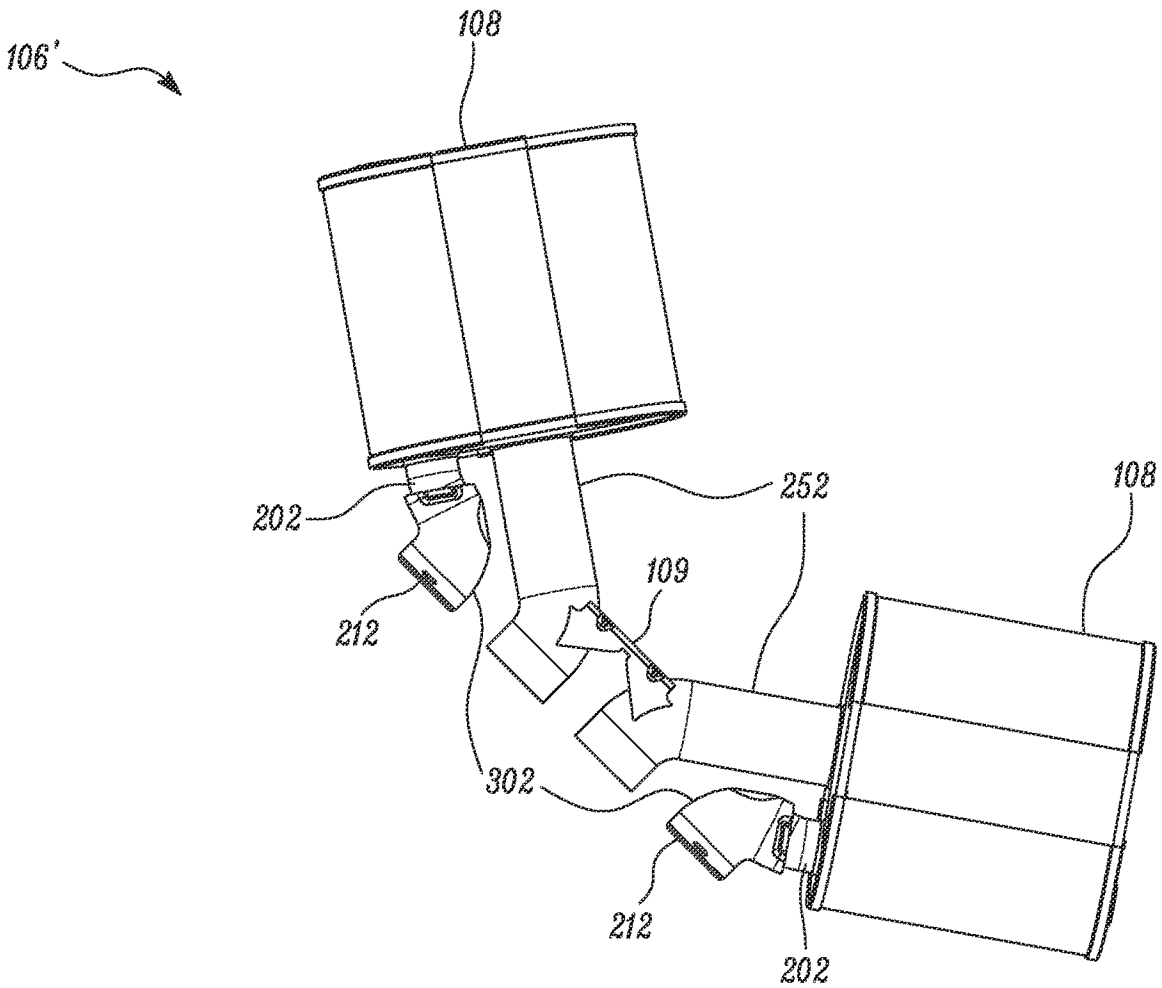
FIG. 10 is a top perspective view of an exhaust assembly of the vehicle exhaust system of FIG. 1, according to another embodiment of the present disclosure.

FIG. 10 is a top perspective view of an exhaust assembly 106', according to an embodiment of the present disclosure. The exhaust assembly 106' is substantially similar to the exhaust assembly 106 of FIGS. 2 and 3. However, the exhaust assembly 106' includes a pair of muffler housings 108. Further, the exhaust assembly 106' includes a pair of first tailpipes 202 connected to corresponding muffler housings 108. Further, the exhaust assembly 106' includes a pair of second tailpipes 252 connected to corresponding muffler housings 108. Each second tailpipe 252 is spaced apart from corresponding first tailpipe 202. Therefore, one muffler housing 108 is connected to each of one first tailpipe 202 and one second tailpipe 252, and the other muffler housing 108 is connected to each of the other first tailpipe 202 and the other second tailpipe 252. The pair of second tailpipes 252 is connected to each other by a bracket 109.

Further, the exhaust assembly 106' includes a pair of baffles 212. One baffle 212 surrounds one first tailpipe 202 at its exit end 204 (shown in FIG. 2) and the other baffle 212 surrounds the other first tailpipe 202 at its exit end 204. The exhaust assembly 106' further includes two pairs of shields 302. Each pair of shields 302 is adapted to at least partially surround the corresponding first tailpipe 202.

While aspects of the present disclosure have been particularly shown and described with reference to the embodiments above, it will be understood by those skilled in the art that various additional embodiments can be contemplated by the modification of the disclosed machines, systems and methods without departing from the spirit and scope of what is disclosed. Such embodiments should be understood to fall within the scope of the present disclosure as determined based upon the claims and any equivalents thereof

What is claimed is:

1. An exhaust assembly comprising:

a first tailpipe comprising an exit end defining an outlet and a curved portion along at least a portion of a length of the first tailpipe, wherein the first tailpipe is adapted to discharge an exhaust gas through the outlet;

a baffle surrounding the first tailpipe at the exit end, the baffle defining a plurality of perforations therethrough; and a pair of shields formed as separate parts, wherein each shield is attached to and at least partially surrounds each of the baffle and the first tailpipe, each shield extending from a first end proximal to the exit end of the first tailpipe to a second end distal to the exit end of the first tailpipe, wherein each shield engages the baffle at the first end and engages the first tailpipe at least at or proximal to the second end, wherein each shield is at least partially curved along its length, such curve being complementary in shape to a curve of the curved portion of the first tailpipe, such that each shield at least partially surrounds the curved portion of the first tailpipe, and wherein the pair of shields is adapted to allow fluid flow to or from the plurality of perforations of the baffle.

2. The exhaust assembly of claim 1, wherein the first tailpipe further comprises a straight portion extending parallel to a longitudinal axis, and wherein the curved portion of the first tailpipe extends from the exit end to the straight portion of the first tailpipe.

3. The exhaust assembly of claim 2, wherein the second end of each shield engages the curved portion of the first tailpipe.

4. The exhaust assembly of claim 2, further comprising a muffler housing connected to the straight portion of the first tailpipe.

5. The exhaust assembly of claim 1, wherein each shield further comprises a pair of opposing longitudinal edges extending from the first end to the second end, wherein each longitudinal edge of one shield is spaced apart from an adjoining longitudinal edge of the other shield, such that the pair of shields define a pair of shield gaps therebetween extending from respective first ends to the respective second ends, and wherein each shield gap is in fluid communication with the plurality of perforations of the baffle.

6. The exhaust assembly of claim 5, wherein each longitudinal edge of each shield at least partially engages the baffle.

7. The exhaust assembly of claim 1, wherein each shield has a first inner diameter at the first end and a second minimum inner diameter at the second end, wherein the first inner diameter is greater than the second minimum inner diameter.

8. The exhaust assembly of claim 7, wherein the baffle has a baffle outer diameter and the first tailpipe has a first outer diameter, wherein the first inner diameter is equal to or greater than the baffle outer diameter, and wherein the second minimum inner diameter is equal to or greater than the first outer diameter of the first tailpipe.

9. The exhaust assembly of claim 1, wherein each shield at least partially tapers from the first end to the second end.

10. The exhaust assembly of claim 1, wherein each shield further comprises at least one opening at the second end, and wherein the at least one opening is in fluid communication with the plurality of perforations of the baffle.

11. The exhaust assembly of claim 10, wherein the at least one opening of each shield is defined between the corresponding shield and the first tailpipe.

12. The exhaust assembly of claim 1, wherein each shield is attached to the baffle at the first end and to the first tailpipe at least at or proximal to the second end.

13. The exhaust assembly of claim 1, wherein each shield is a stamped part.

14. The exhaust assembly of claim 1, further comprising a second tailpipe spaced apart from the first tailpipe and having a second outer diameter greater than a first outer diameter of the first tailpipe, and wherein the baffle has a baffle outer diameter substantially equal to the second outer diameter of the second tailpipe.

15. The exhaust assembly of claim 14, further comprising a muffler housing connected to each of the first tailpipe and the second tailpipe.

16. An exhaust assembly comprising:

a muffler housing;

a first tailpipe connected to the muffler housing and having a first outer diameter, the first tailpipe comprising an exit end defining an outlet and a curved portion along at least a portion of a length of the first tailpipe, wherein the first tailpipe is adapted to discharge an exhaust gas through the outlet;

a baffle surrounding the first tailpipe at the exit end, the baffle defining a plurality of perforations therethrough, the baffle having a baffle outer diameter;

a pair of shields formed as separate parts, wherein each shield is attached to and at least partially surrounds each of the baffle and the first tailpipe, each shield extending from a first end proximal to the exit end of the first tailpipe to a second end distal to the exit end of the first tailpipe, wherein each shield engages the baffle at the first end and engages the first tailpipe at least at or proximal to the second end, wherein each shield is at least partially curved along its length, such curve being complementary in shape to a curve of the curved portion of the first tailpipe, such that each shield at least partially surrounds the curved portion of the first tailpipe, and wherein the pair of shields is adapted to allow fluid flow to or from the plurality of perforations of the baffle; and a second tailpipe spaced apart from the first tailpipe and connected to the muffler housing, the second tailpipe having a second outer diameter greater than the first outer diameter of the first tailpipe and substantially equal to the baffle outer diameter of the baffle.

17. The exhaust assembly of claim 16, wherein the first tailpipe further comprises a straight portion extending parallel to a longitudinal axis and connected to the muffler housing, wherein the curved portion of the first tailpipe extends from the exit end to the straight portion of the first tailpipe, and wherein the second end of each shield engages the curved portion of the first tailpipe.

18. The exhaust assembly of claim 16, wherein each shield further comprises a pair of opposing longitudinal edges extending from the first end to the second end, wherein each longitudinal edge of one shield is spaced apart from an adjoining longitudinal edge of the other shield, such that the pair of shields define a pair of shield gaps therebetween extending from respective first ends to the respective second ends, and wherein each shield gap is in fluid communication with the plurality of perforations of the baffle.

19. The exhaust assembly of claim 16, wherein each shield further comprises at least one opening at the second end, and wherein the at least one opening is in fluid communication with the plurality of perforations of the baffle.

20. The exhaust assembly of claim 16, wherein each shield is attached to the baffle at the first end and to the first tailpipe at least at or proximal to the second end.

* * * * *